US005279451A

United States Patent [19]

Mueller et al.

[11] Patent Number: 5,279,451

[45] Date of Patent: Jan. 18, 1994

[54] DISPENSING CLOSURE WITH TWIST COLLAR

[75] Inventors: Bruce M. Mueller, Brookfield; Richard J. Daniels, Caledonia, both of Wis.; John R. Nottingham, Moreland Hills; Dale A. Panasewicz, Strongsville, both of Ohio; Guy E. Wilson, Woodstock, Ill.

[73] Assignee: AptarGroup, Inc., Crystal Lake, Ill.

[21] Appl. No.: 848,423

[22] Filed: Mar. 6, 1992

[51] Int. Cl.[5] ..... B67D 3/00; B67D 5/06; B65D 47/00

[52] U.S. Cl. ..... 222/507; 222/534; 222/556

[58] Field of Search ..... 222/505, 508, 509, 519, 222/522, 544, 545, 548, 549, 550, 553, 556, 507, 534

[56] References Cited

U.S. PATENT DOCUMENTS

| | | | |
|---|---|---|---|
| 2,495,015 | 1/1950 | McGrath | 222/507 |
| 2,558,671 | 6/1951 | Cherry | 222/507 |
| 2,779,519 | 1/1957 | Rossetti . | |
| 3,007,614 | 11/1961 | Morrow . | |
| 3,703,250 | 11/1972 | Middleton . | |
| 3,847,313 | 11/1974 | Micallef | 222/549 X |
| 4,047,643 | 9/1977 | Hazard . | |
| 4,141,476 | 2/1979 | Rech | 222/507 X |
| 4,412,634 | 11/1983 | Bennett . | |
| 4,487,342 | 12/1984 | Shy . | |
| 4,776,501 | 10/1988 | Ostrowsky . | |
| 4,836,423 | 6/1989 | Hayes et al. | 222/519 X |
| 4,838,460 | 6/1989 | Moore et al. . | |
| 4,982,882 | 1/1991 | Gueret . | |
| 5,004,127 | 4/1991 | Morel . | |
| 5,044,530 | 9/1991 | Stull | 222/549 X |
| 5,065,912 | 11/1991 | Rosenthal . | |

*Primary Examiner*—Andres Kashnikow
*Assistant Examiner*—Kenneth DeRosa
*Attorney, Agent, or Firm*—Dressler, Goldsmith, Shore & Milnamow, Ltd.

[57] ABSTRACT

A dispensing closure is provided for a container and includes a base for being mounted to the container over the container opening. An actuator is mounted on the base and is tiltable between a closed position and an open position. A ring is mounted on the base for rotation relative to the base and actuator. The ring and base together cooperatively define a cam drive system for effecting the tilting of the actuator.

29 Claims, 4 Drawing Sheets

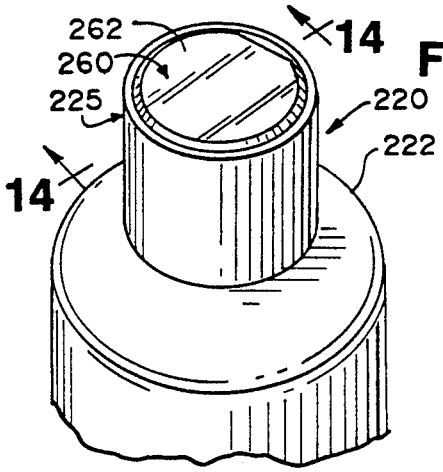
Fig. 9
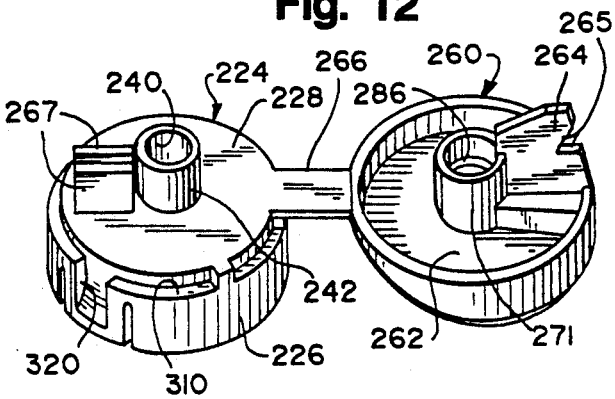
Fig. 12
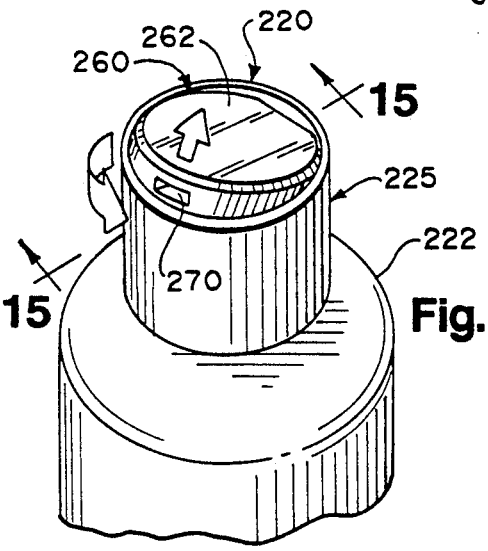
Fig. 10
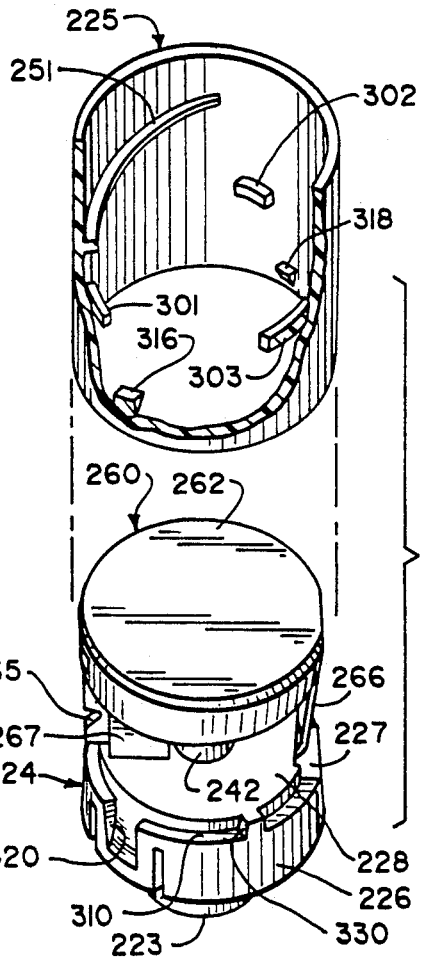
Fig. 11
Fig. 13
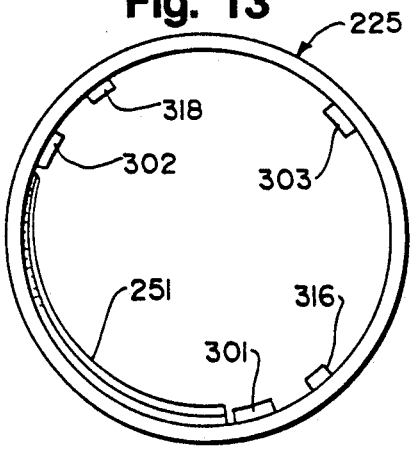

DISPENSING CLOSURE WITH TWIST COLLAR

TECHNICAL FIELD

This invention relates to closures for containers, and more particularly to a dispensing closure which can be manipulated between a closed orientation and an open, dispensing orientation.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a flip-up spout or nozzle assembly for dispensing the container contents. See, for example, U.S. Pat. Nos. 4,776,501, 4,645,086 and 3,516,581.

The closures disclosed in the above-referenced patents require that the operator push down on a top, rear portion of the closure in order to pivot the closure to the dispensing orientation. On the other hand, U.S. Pat. No. 4,838,460 discloses a closure in which a tiltable actuator is mounted within a rotatable collar, and rotation of the collar operates through a cam ring to tilt the actuator between the closed and open positions.

While the tiltable actuator within a rotatable collar as disclosed in the U.S. Pat. No. 4,838,460 may function generally satisfactorily for the purpose for which it was designed, it would be desirable to provide an improved dispensing closure with structural and operational advantages.

Specifically, it would be desirable to provide a cam drive system that could be located in a relatively small region of the closure and that would not require extensive circumferential cam tracks around all or most of the closure.

Further, it would be advantageous if the components of such an improved design could be relatively easily manufactured and readily assembled.

Additionally, it would be beneficial if such an improved design could provide a "high-style" exterior configuration substantially free from functional details and instructional nomenclature or indicia.

Finally, it would be desirable to provide an improved design which would accommodate the torque encountered during application of the closure to a container in an automatic, high-speed, capping machine or encountered during use of the closure by a person who may inadvertently or intentionally apply an unusually high torque to the closure.

The present invention provides an improved closure which can accommodate designs having the above-discussed benefits and features.

SUMMARY OF THE INVENTION

The present invention provides a novel dispensing closure which can have a contemporary, clean design with virtually no visible functional details or instructional nomenclature. The closure components can be relatively easily manufactured and readily assembled. The design can accommodate significant torque that could be applied to the closure during application of the closure to a container with an automatic capping machine.

The closure includes a base for being mounted to a container at the container opening. The base is held tightly on the container, as with a suitable threaded engagement, so that it is restrained against rotation relative to the container during normal operation of the closure. The base defines a discharge passage for communicating with the container opening.

An actuator is mounted on the base to prevent any substantial, relative, rotational movement between the base and actuator about a central axis while accommodating movement of the actuator between a closed position occluding the discharge passage and an open position permitting flow out of the discharge passage. In a preferred embodiment, a hinge means is provided for mounting the actuator on the base, and the hinge means is spaced from the base discharge opening.

In the preferred form, the hinge means includes a pair of spaced-apart pedestals on the base, and each pedestal defines a fulcrum member having an engaging surface that is at least partially cylindrical. The actuator has a pair of spaced-apart bearing members which each define a bearing surface that is at least partially cylindrical for engaging one of the fulcrum members to accommodate the tilting of the actuator.

A collar or ring is mounted on the base for rotation relative to the base and actuator about the central axis. The ring and actuator together define a cooperating cam drive means for effecting the tilting of the actuator between the open and closed positions.

According to one aspect of the invention, the cam drive means preferably includes a cam member extending radially inwardly from the ring, and the actuator defines at least one groove extending along a portion of a helix for receiving the cam member in driving engagement.

According to a further aspect of the invention, the ring preferably includes a radially inwardly extending stop member. Either the base or the actuator defines an abutment which is axially aligned with the stop member. Thus, rotation of the ring in a selected direction carries the cam member in the groove to move the actuator to one of the open and closed positions and carries the stop member into engagement with the abutment to prevent further rotation in that direction.

In a preferred form of the cam drive means, the actuator defines a pair of spaced-apart grooves that (1) are each circumferentially spaced from the hinge means, (2) each define a portion of the helix that is substantially identical to the other portion, and (3) are circumferentially offset relative to each other but have the same axial position on the actuator. The ring has a pair of cam members for being received in the grooves.

According to a further aspect of the invention, at least a portion of either the ring or the base is resilient to accommodate temporary radial deflection. Further, the base defines an outwardly projecting flange. The ring has a generally cylindrical inner surface around the flange. The ring defines at least one lower retention member that projects inwardly from the inner surface and terminates in a distal inner end.

The ring further defines at least one upper retention member that projects inwardly from the inner surface and that is axially spaced from the lower retention member. The upper retention member has an engaging surface facing generally in the axial direction toward the lower retention member. The lower retention member defines a support surface facing generally in the axial direction toward the upper retention member.

The lower retention member further defines a guide surface extending from the distal inner end of the lower retention member toward the ring cylindrical inner surface so that the axial distance between the support surface and guide surface increases with increasing radial distance from the inner end of the lower retention member. This structure permits the base to be inserted into the ring with the ring flange being guided by the lower retention member guide surface to radially deflect at least a portion of either the base or ring to accommodate movement of the base flange past the inner end of the lower retention member. This causes the base flange to be lodged between the ring upper and lower retention members.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 9 is a perspective view of a second embodiment of the closure of the present invention shown in a closed orientation;

FIG. 10 is a perspective view of the second embodiment of the closure of the present invention shown in an open orientation;

FIG. 11 is an enlarged, exploded, perspective view of the second embodiment closure;

FIG. 12 is a perspective view of the body and actuator of the second embodiment of the closure in an as-molded configuration prior to being reconfigured and assembled with the closure ring;

FIG. 13 is an enlarged, plan view of the ring of the second embodiment of the closure;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in the normal (upright) operating position, and terms such as upper, lower, horizontal, etc., are used with reference to this position. It will be understood, however, that the closure of this invention may be manufactured, stored, transported, used, and sold in an orientation other than the position described.

Figure 1:
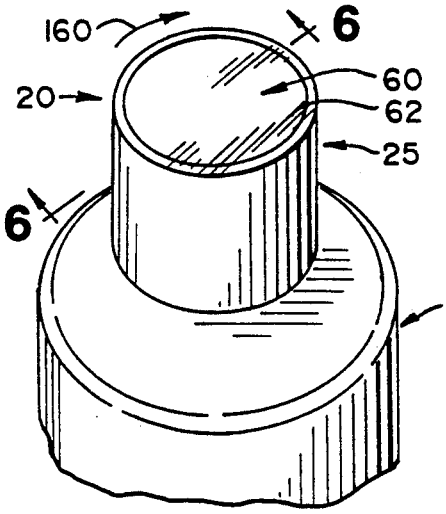
FIG. 1 is a perspective view of the closure of the present invention shown in a closed orientation.

A first embodiment of the dispensing closure of the present invention is illustrated in FIG. 1 wherein the closure is represented generally by reference numeral 20. The closure 20 is adapted to be mounted on a container 22 which may have a conventional open mouth defined by a neck 23 (FIG. 6) or other suitable structure.

Figure 3:
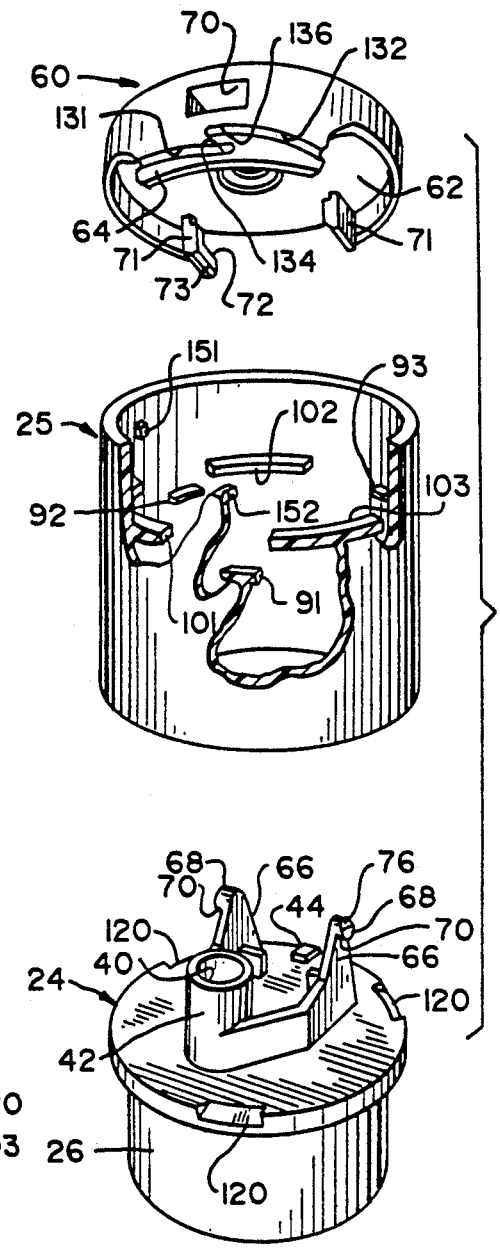
FIG. 3 is an enlarged, exploded, perspective view of the closure.

As best illustrated in FIG. 3, the closure 20 includes a closure base 24 for securement to the container 22. In the illustrated first embodiment, a rotatable collar or ring 25 is mounted to the closure base 24, but the rotatable collar or ring 25 is not directly attached to the container 22. The base 24 includes a generally cylindrical, peripheral wall 26 and a generally transverse closure wall, deck, or flange 28 which extends across the top of the base 24.

The cylindrical wall 26 of the closure base 24 is adapted to engage the outer periphery of the top of the container neck 23 (FIG. 6)around the container mouth (as with threads, not illustrated). Other suitable engaging means (e.g., snap-fit beads with anti-rotation stops) may be provided to secure the closure base 24 on the container 22—providing that the base 24 is secured sufficiently tightly to the container to prevent relative rotation between the base 24 and container 22 during normal use of the closure 20. Alternatively, in some applications the closure base 24 could be non-releasably attached to, or formed unitary with, the container 22.

Figure 6:
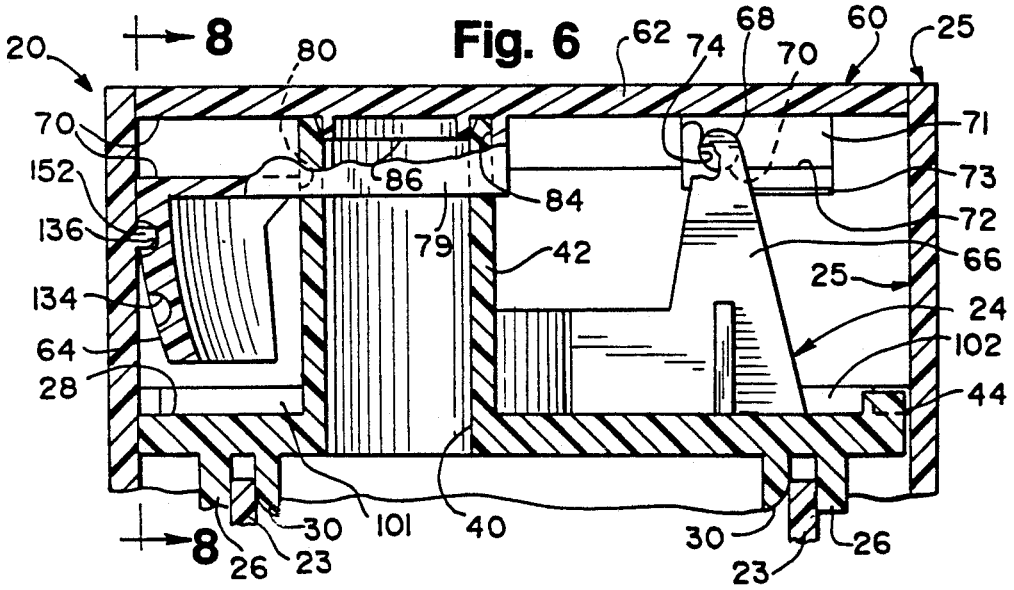
FIG. 6 is a greatly enlarged, fragmentary, cross-sectional view taken generally along the plane 6—6 in FIG. 1.

An annular sealing ring 30 may be provided as shown in FIG. 6 for engaging an interior edge of the container neck 23 at the container mouth to effect a tight seal.

The closure base 24 includes a discharge passage 40 as best illustrated in FIGS. 3, 4, 6, and 7. In the preferred embodiment, the closure base 24 includes a discharge tube 42 projecting upwardly from the deck or flange 28, and the discharge passage 40 is defined within the tube 42. The tube 42 communicates through the flange 28 with the container interior at the lower end of the tube 42 through the discharge passage 40.

The closure base 24 includes an abutment 44 (FIGS. 3, 4, 6, and 7) which projects upwardly from the flange 28 at the periphery of the flange. The abutment 44 is adapted to intermittently engage portions the ring 25 during operation of the closure 20 in a manner described in detail hereinafter.

Figure 2:
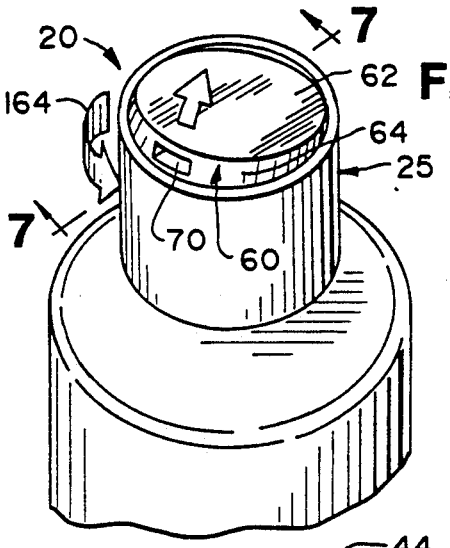
FIG. 2 is a perspective view of the closure shown in an open orientation.
Figure 8:
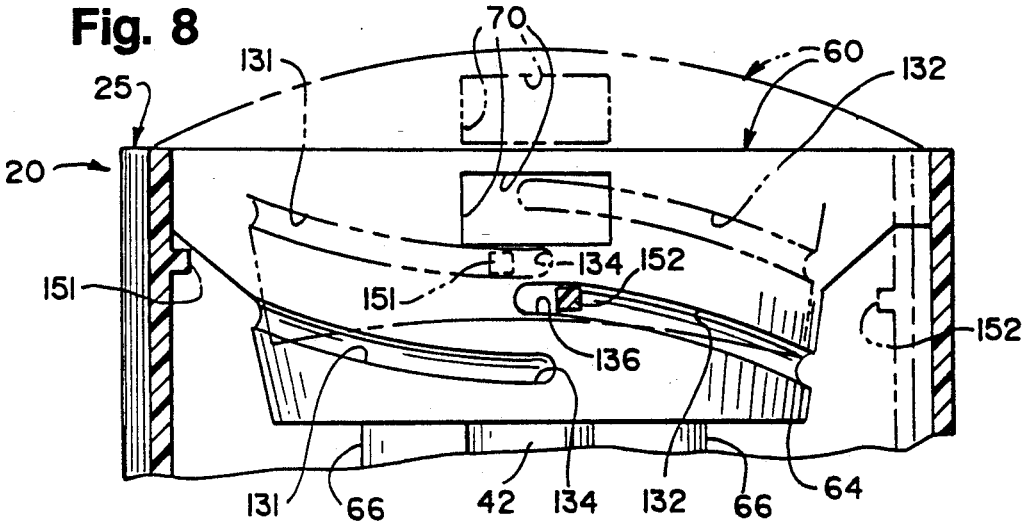
FIG. 8 is a cross-sectional view taken generally along the plane 8—8 in FIG. 6 with the tilted open orientation of the closure shown in phantom by dashed lines.

The closure body 24 receives a nozzle assembly or actuator 60 as best illustrated in FIGS. 1, 2, 3, 6, 7, and 8. The actuator 60 includes a cooperating top wall 62 (FIGS. 1, 2, 3, 6, and 7) and a depending front flange 64 (FIGS. 2, 3, and 8).

The actuator 60 also has a pair of spaced-apart, depending, bearing members 71 (FIGS. 3, 6, and 7) which are spaced from the discharge passage 40. The members 71 cooperate with the base 24 to define a hinge means accommodating the tilting of the actuator 60 between a closed position (FIG. 1) occluding the discharge passage 40 and an open position (FIG. 2) permitting flow out of the discharge passage 40.

In particular, the closure base 24 includes a pair of spaced-apart pedestals 66 (FIGS. 3, 4, 6, and 7) defining a pair of oppositely facing fulcrum members 68 which each have an engaging surface 70 which is at least partially cylindrical. The actuator bearing members 66 each include an inwardly facing track or ledge 72 having at least a partially cylindrical bearing surface 74 but (FIG. 6) at one end for engaging the partially cylindrical surface 70 of one of the pedestal fulcrum members 68 to accommodate the tilting of the actuator 60 relative to the base 24.

Figure 4:
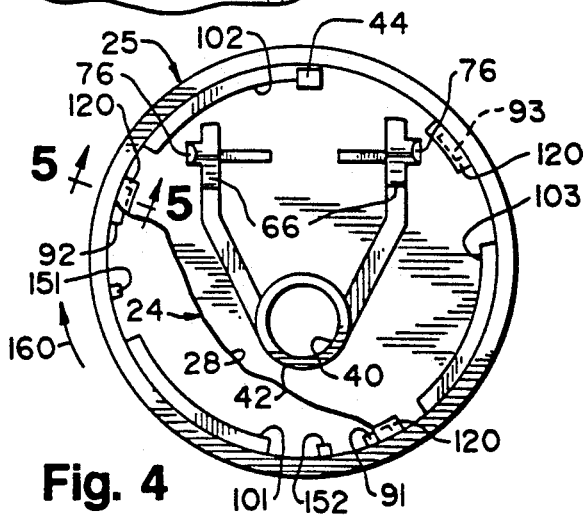
FIG. 4 is a plan view of the closure base mounted within the collar or ring and with the actuator omitted to reveal underlying detail.

In a preferred form of the invention, the base pedestals 66 and/or the actuator bearing members 71 are sufficiently resilient to accommodate assembly of the actuator 60 onto the base 24. In particular, the pedestals 66 may be sufficiently resilient to be deflected inwardly and/or actuator bearing members 71 may be sufficiently resilient to deflect outwardly as the actuator 60 and base 24 are pushed together into the initially closed relationship illustrated in FIG. 6 To assist in this process, wherein each base fulcrum member 68 is forced past, and located on top of, the actuator bearing member ledge 72, the top of each fulcrum member 68 is preferably chamfered as indicated in FIGS. 3 and 4 by reference numeral 76. Further, the bottom edge of each bearing member 71 is chamfered as indicated at reference numeral 73 in FIGS. 3, 7, and 8.

To facilitate the mounting of the actuator 60 to the base pedestals 66, the actuator bearing members 71 each preferably having a chamfer 73 (FIGS. 6 and 7) along the bottom inside edge.

When the actuator 60 is pivotally mounted to the closure base 24, the actuator 60 can be pivoted, by novel means described in detail hereinafter, from the closed position (FIGS. 1 and 6) to the open position (FIGS. 2 and 7) so that the forward end of the actuator 60 is exposed above the top of the closure collar or ring 25.

Figure 7:
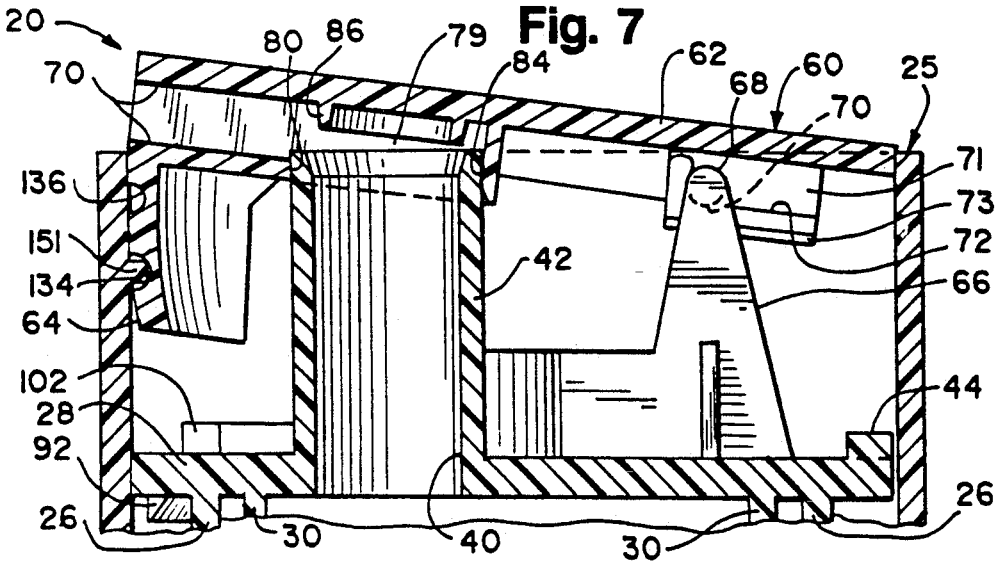
FIG. 7 is a greatly enlarged, fragmentary, cross-sectional view taken generally along the plane 7—7 in FIG. 2

The actuator 60 includes a structure on the bottom surface of the top wall 62 which functions—depending upon the orientation of the actuator 60—to either permit dispensing of flowable material from the container discharge tube 42 or occlude the passage 40 to prevent flow out of the discharge tube 42. In particular, as shown in FIGS. 6 and 7, the actuator 60 includes a forwardly extending nozzle or channel 70 which merges with, and opens into, a partially cylindrical sealing wall 79. The wall 79 surrounds and seals the upper periphery of the discharge tube 42 when the actuator 60 is in the closed position as illustrated in FIG. 6. For example, the wall 79 forms a seal around the outer periphery of the discharge tube 42 as indicated by reference number 80 at the front of the tube 42 and as indicated by the reference numeral 84 at the rear of the tube 42.

Preferably, a sealing plug 86 projects downwardly from the bottom of the actuator top wall 62. The sealing plug 86 has a generally cylindrical or annular configuration and is adapted to enter into the opening at the top of the discharge tube 42 to sealingly occlude the discharge passage 40 in the tube 42 when the actuator is in the closed position as illustrated in FIG. 6.

On the other hand, when the actuator 60 is tilted to the dispensing position as illustrated in FIG. 7, then the front portion of the sealing plug 86 is tilted away from the top of the discharge tube 42 to permit flow of the material out of the discharge passage in the tube 42 through the dispensing nozzle 70. When the actuator 60 is tilted to the dispensing position as illustrated in FIG. 7, the wall 79 still continues to seal the outer periphery of the upper end of the discharge tube 42 so that the container contents, while being dispensed into the nozzle 70, cannot leak out around the top of the discharge tube 42.

The twist ring or collar 25 includes novel structures for accommodating the mounting of the ring 25 on the closure base 24 for rotation relative to both the base 24 and the actuator 60. In particular, and as can be seen in FIGS. 3 and 4, the ring 25 defines three, lower, retention members 91, 92, and 93. The ring 25 also defines three upper retention members 101, 102, and 103 which each project inwardly from the inner surface of the ring 25. The upper retention members 101, 102, and 103 are axially spaced from the lower retention members 91, 92, and 93.

Figure 5:
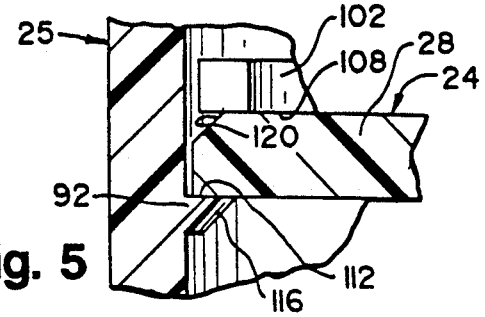
FIG. 5 is a greatly enlarged, fragmentary, cross-sectional view taken generally along the plane 5—5 in FIG. 4.

As illustrated in FIG. 5, the flange 28 of the closure base 24 is received between the upper retention members (such as upper retention member 102 illustrated in FIG. 5) and the lower retention members (such as the lower retention member 92 illustrated in FIG. 5). To this end, each upper retention member 101, 102, and 103 has an engaging surface, such as surface 108 for the upper retention member 102 illustrated in FIG. 5, and that surface faces generally in the axial direction toward the lower retention members 91, 92, and 93. Each lower retention member defines a support surface, such as the support surface 112 for the lower retention member 92 illustrated in FIG. 5, which faces generally upwardly in the axial direction toward the upper retention members 101, 102, and 103.

The lower retention members also each define a guide surface, such as the guide surface 116 illustrated for the lower retention member 92 in FIG. 5, and the guide surface 116 extends from the distal, inner end of the lower retention member toward the cylindrical inner surface of the ring 25. The arrangement of the guide surface on each lower retention member, such as the guide surface 116 on the lower retention member 92 illustrated in FIG. 5, may be characterized as extending from the inner end of the retention member toward the inner surface of the ring 25 in such a way that the axial distance between the support surface 112 and the guide surface 116 increases with increasing radial distance outwardly from the inner end of the lower retention member.

The flange 28 of the closure base 24 has three spaced-apart chamfers 120 (FIGS. 3 and 4) which are each adapted to be aligned with one of the ring lower retention members 91, 92, or 93 during initial assembly of the closure 20. The novel chamfered structure of the base flange 28 and of the retention members 91, 92, and 93 facilitates assembly of the ring 25 and base 24. Further, at least a portion of either the ring 25 or base 24, or both, is sufficiently resilient to accommodate a temporary radial deflection.

To initially assemble the ring 25 and the base 24, the ring 25 and base 24 are arranged in axial alignment substantially as shown in FIG. 3. When the base 24 and ring 25 are initially oriented for assembly as illustrated in FIG. 3, the base flange chamfers 120 are generally axially aligned with the ring lower retention members 91, 92, and 93. Further, upwardly projecting abutment 44 on the base is aligned to be adjacent an end of the ring upper retention member 102 as illustrated in FIG. 4.

Next, relative movement is effected to bring the base flange 28 into position between the ring upper retention members 101, 102, and 103 and the lower retention members 91, 92, and 93 as shown in FIG. 4 (and as shown in more detail in FIG. 5 for the upper retention member 102 and lower retention member 92).

As the relative movement is effected between the ring 25 and base 24, the base flange 28 contacts and slides along the ring lower retention member guide surfaces (such as guide surface 116 on lower retention member 92 as illustrated in FIG. 5). This sliding engagement is enhanced by the bevel or chamfer 120 on the upper edge of the base flange 28 as illustrated in FIGS. 3 and 5.

When sufficiently large, opposed, axial forces are applied to the ring 25 and base 24, there is sufficient temporary deflection or deformation of one or both of the components in the radial direction so that the flange 28 slides past the inner ends of the lower retention members 91, 92, and 93 and become lodged between the lower retention members and the upper retention members 101, 102, and 103.

In the preferred form of assembling the closure components, the ring 25 and base 24 are first assembled as described above. Subsequently, the actuator cap 60 is pushed down into the ring 25 and onto the pedestals 66 of the closure base 24 to effect the engagement of the pedestal fulcrum members 68 with the actuator bearing members 71 as previously described.

When the actuator 60 is properly mounted to the base 24 in the ring 25, novel structures in the actuator 60 and ring 25 cooperate to define a unique cam drive means for effecting the tilting of the actuator 60 between the open and closed positions. In particular, the actuator front flange 64 defines a pair of spaced-apart grooves 131 and 132 as illustrated in FIGS. 3 and 8. The grooves 131 and 132 are circumferentially spaced from the hinge means defined by the cooperative engagement between the pedestals 66 and the actuator bearing members 71.

Each groove 131 and 132 defines a portion of a helix. The helix portions of the grooves 131 and 132 are substantially identical. The grooves 131 and 132 are circumferentially offset relative to each other but have substantially the same axial position on the actuator flange 64.

The groove 131 is open to one side edge of the actuator flange 64 and terminates in a closed portion 134 below the dispensing channel 70. Similarly, the groove 132 is open at the other side edge of the actuator flange 64 and terminates in a closed portion 136 below the channel 70. As can be seen in FIG. 8, the groove end portions 134 and 136 are not part of the helical configuration of the grooves. Rather, the end portions 134 and 136 each define a small circular arc (non-helical) extending in an orientation generally transverse to the longitudinal axis of the closure.

The collar or ring 25 defines a pair of radially inwardly extending cam members 151 and 152 as illustrated in FIGS. 3 and 4. When the actuator 60 is initially mounted to the closure base 24 within the ring 25 as described above, the cam member 152 is initially received in the end portion 136 of the groove 132, and the cam member 151 is located just beyond the open end of the other groove 131 as illustrated in solid line in FIG. 8. To aid in locating the cam member 152 in the groove 131 during initial assembly of the closure, the bottom portion of the actuator flange 64 is provided with an inwardly extending, curved or tapered lead as shown in FIG. 6. This facilitates entry of the cam member 152 into the groove arc portion 136 when the actuator 60 is initially pushed down onto the base 24 within the ring 25.

In the initially assembled condition, the closure is in the "closed" orientation. In this closed orientation, the upwardly projecting abutment member 44 (FIGS. 4 and 6) on the closure base 24 is adjacent the end of the ring upper retention member 102. The assembled, closed closure can be then applied to a container, such as the container 22.

Preferably, the closure 20 is applied to the container 22 automatically by a conventional, high-speed, capping machine, the details of which form no part of the present invention. If the closure base 24 is provided with a conventional right-hand thread for engaging a mating thread on the neck of the container 22, then the closure 20 would be rotated, with reference to FIGS. 1 and 4, in the clockwise direction as indicated by the arrows 160. Typically, the automatic capping machine would grip the exterior surface of the ring 25 to effect the threading of the closure 20 onto the container 22.

When the closed closure 20 is thus applied to the container 22, the ring upper retention member 102 engages the base abutment 44 as shown in FIG. 4. This establishes a driving engagement between the ring 25 and the base 24 so as to thread the base 24 onto the neck of the container 22.

It will be appreciated that the cam member 152, being located within the short, horizontal arc portion 136 of the groove 132, and being spaced from the closed end of the arc portion 136, does not therefor transmit any rotational force or torque to the actuator 60. Because the driving force for threading the closure onto a container 22 is transmitted from the ring upper retention member 102 to the relatively massive abutment member 44 of the base 24, and because the cam member 152 is essentially not drivingly engaged with the walls of the groove portion 136 during the closure applying process, the cam member 152 need not be designed to accommodate the relatively high torque stresses to which the more massive ring upper retention member 102 and base abutment 44 are subjected. Thus, the cam member 152 can be made relatively small—both with respect to its cross section where it projects from the ring 25 and with respect to the length of its inward projection into the groove 132. The cam member 151 can be similarly small because the cam member 151 is completely beyond the end of the groove 131 when the closure is in the closed position and being initially applied to the container.

After applying the closure (while it is in the closed orientation) to the container 22, the closure 20 can be easily opened to the dispensing orientation by rotating the collar or ring 25 (in the counterclockwise direction as indicated by the arrow 164 in FIG. 2). With reference to FIG. 4, it can be seen that as the ring rotates in the counterclockwise direction (opposite to the direction of the arrow 160 in FIG. 4), the upper retention member 102 will be carried away from the closure base abutment 44 as all three upper retention members 101, 102, and 103 move around the top of the base flange 28. During this initial rotation of the ring 25 in the counterclockwise direction, neither the base abutment 44 nor any other part of the base 24 is positively engaged in a driving relationship by the ring 25. Accordingly, the base 24 remains tightly engaged with the neck of the container 22.

As the ring 25 is rotated in the direction of the arrow 164 in FIG. 2, the cam member 152 (FIG. 8) is rotated into the helical portion of the groove 132, and this drives the front of the actuator 60 upwardly (to the position shown in dashed lines in FIG. 8 and to the position shown in solid lines in FIG. 7). At the same time, the cam member 151 enters the open end of the groove 131 and also helps drive the front of the actuator 60 upwardly.

In the fully raised, opened position (FIGS. 7 and 8), the cam member 152 has been carried out of the open end of the groove 132, and the cam member 151 has entered the short circular arc portion 134 of the groove 131 as illustrated in phantom lines in FIG. 8. However, before the cam member 151 is carried all the way to the end of the short circular arc portion 134, the ring upper retention member 103 (FIG. 4) is carried into engagement with the base abutment 44 to terminate further rotation of the ring 25. Thus, the cam member 151 is not permitted to engage the end of the groove circular arc portion 134. Therefore, the cam member 151 is not subjected to a high shear stress. Accordingly, the cross sectional thickness of the cam member 151 need be only large enough to accommodate the relatively small camming forces associated with tilting the actuator 60

When the actuator 60 is in the open orientation (FIGS. 2 and 7), the contents can be dispensed from the container. Typically, the container 22 has flexible walls which can be squeezed to force the container contents out through the dispensing channel 70 of the actuator 60. When it is desired to close the actuator, the ring 25 can be rotated back in the opposite direction (in the direction opposite the arrow 164 in FIG. 2) to reverse the movement of the cam members 151 and 152 in the grooves and drive the actuator to the closed position.

If desired, in an alternate form of the closure (not illustrated), the base abutment 44 could be eliminated. In such a design, the actuator grooves 131 and 132 would not have to be provided with the short, circular arc portions 134 and 136, respectively. The cam member 151 would be adapted to engage the end of the groove 131 at the termination of the rotation of the ring 25 to the open position, and the cam member 152 would be adapted to engage the end of the groove 132 in the closed position of the actuator 60. The cam members 151 and 152 would thus have to be made strong enough (i.e., have a large enough cross section) to accommodate the termination stresses. In addition, the cam member 152 would have to be strong enough to accommodate the closure-applying torque when the closure is initially applied to the container (i.e., when the ring 25 is rotated in the direction of the arrow 160 illustrated in FIG. 4).

It will also be appreciated that the engagement between the ring 25 and closure base 24 may take other forms that would provide for axial retention while permitting relative rotation to operate the actuator 60. For example, a greater or lesser number of upper retention members 101, 102, and 103 could be provided on the ring 25. Similarly, a greater or lesser number of lower retention members 91, 92, and 93 could be provided on the ring 25. Alternatively, the retention members may have other suitable structures.

The closure of the present invention illustrated in FIGS. 1–8 may include just one cam groove (similar to grooves 131 and 132) for cooperating with just one cam member (similar to members 151 and 152). With such a structure, the helical configuration of the groove would define a steeper angle relative to the longitudinal axis, and this could be accommodated by providing a thicker actuator or longer front flange or skirt 64.

A second embodiment of the closure of the present invention is illustrated in FIG. 9–15 wherein the closure is designated generally by the number 220. The closure 220 is adapted to be mounted on a container 222 which may have a conventional open mouth defined by a neck or other suitable structure (not illustrated).

As best illustrated in FIGS. 11 and 12, the closure 220 includes a closure base 224 for securement to the container 222. Preferably, the base 224 is molded as a unitary part of a structure that includes an actuator 260 which is connected to the base 224 by means of a flexible, strap hinge 266.

A rotatable collar or ring 225 is mounted to the closure base 224. The collar or ring 225 is not directly attached to the container 222.

Figure 14:
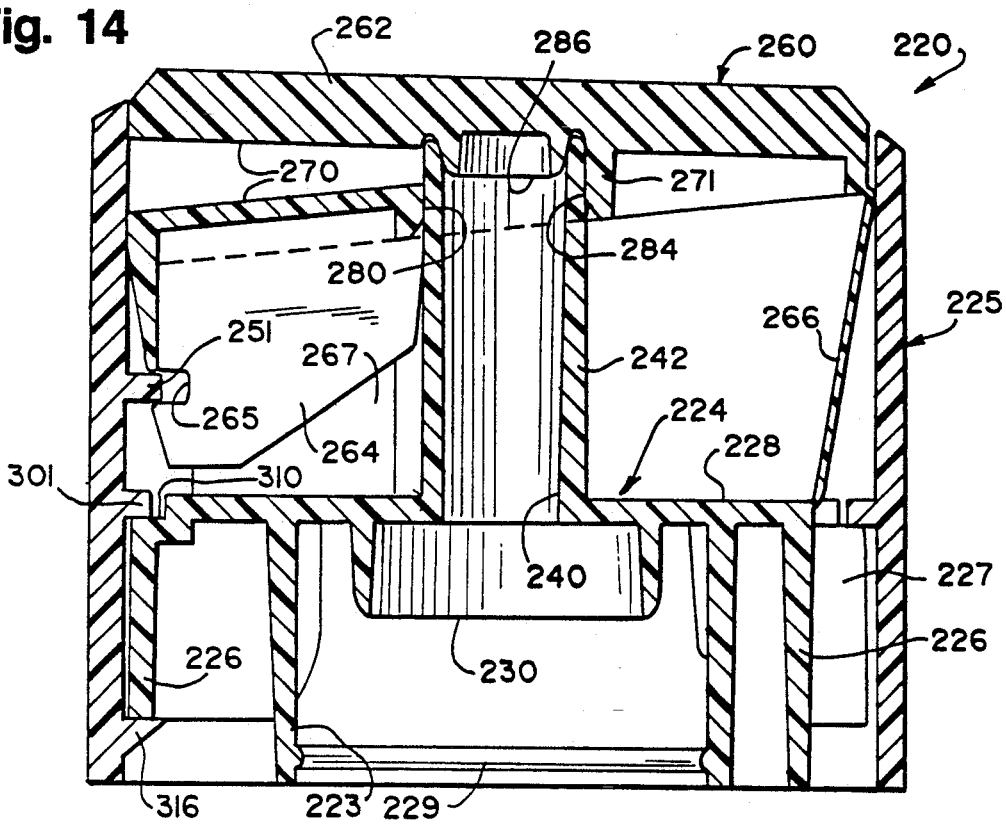
FIG. 14 is a greatly enlarged, cross-sectional view taken generally along the plane 14—14 in FIG. 9 with the container omitted for ease of illustration.

As best illustrated in FIGS. 12 and 14, the closure base 224 includes a generally cylindrical, peripheral wall or flange 226 and a generally transverse closure wall or deck 228. As best illustrated in FIGS. 11 and 14, the peripheral wall 226 defines a notch 227 below the hinge strap 266.

The closure base 224 includes a reduced diameter cylindrical wall 223 which is adapted to engage the outer periphery of the top of a neck of the container 222 around the container mouth (not illustrated). In this embodiment, a snap-fit bead 229 (FIGS. 14 and 15) is provided on the inside of the wall 223 to engage suitable means (e.g., snap-fit beads) on the container neck (not illustrated). In addition, anti-rotation ribs 231 and 233 are provided on the inside of the wall 223 above the bead 229 for engaging similar ribs (not illustrated) on the exterior of the container neck. This functions to prevent rotation of the closure 220 on the container 222.

Figure 15:
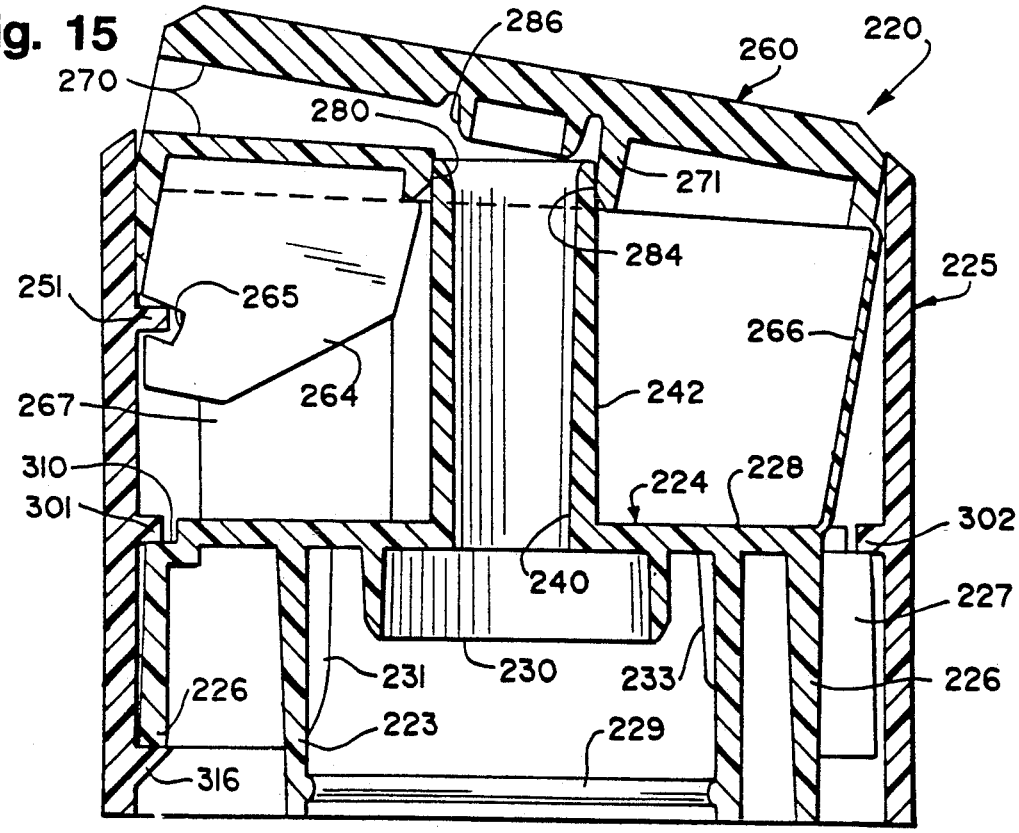
FIG. 15 is a greatly enlarged, cross-sectional view taken generally along the plane 15—15 in FIG. 10 with the container omitted for ease of illustration.

An annular sealing ring 230 may be provided as best illustrated in FIGS. 14 and 15 for engaging an interior edge of the container neck at the container mouth to effect a tight seal.

The closure base 224 includes a discharge passage 240 as illustrated in FIGS. 12, 14, and 15. A discharge tube 242 projects upwardly from the deck 228, and the discharge passage 240 is defined within the tube 242. The tube 242 communicates through the deck 228 with the container interior at the lower end of the tube 242 through the discharge passage 240.

The closure body 224 carries the actuator 260, as best illustrated in FIGS. 11, 14, and 15, so as to accommodate tilting of the actuator 260. The actuator 260 can be pivoted, by novel means described in detail hereinafter, from the closed position (FIGS. 9 and 14) to the open position (FIGS. 10 and 15) so that the forward end of the actuator 260 is exposed above the top of the closure collar or ring 225.

The actuator 260 has a top wall 262 which, when the actuator 260 is in the closed position (FIG. 14), extends substantially completely across the interior of the ring 225. The actuator 260 includes a structure on the bottom surface of the top wall 262 which functions—depending upon the orientation of the actuator 260—to either permit dispensing of the flowable material from the container discharge tube 242 or occlude the passage 240 to prevent flow out of the discharge 242.

In particular, as shown in FIGS. 14 and 15, the actuator 260 includes a forwardly extending nozzle or channel 270 which merges with, and opens into, a generally cylindrical sealing wall 271 (FIG. 12). As illustrated in FIG. 14, the sealing wall 271 seals the upper periphery of the tube 242 when the actuator 260 is closed (FIG. 14). FIG. 14 shows a front portion 280 of the wall 271 sealing the front of the tube 242, and FIG. 14 shows a rear portion 284 of the wall 271 sealing a rear part of the tube 242.

Preferably, a sealing plug 286 projects downwardly from the bottom of the actuator top wall 262. The sealing plug 286 has a generally cylindrical or annular configuration and is adapted to enter into the opening at the top of the discharge tube 242 to sealingly occlude the discharge passage 240 in the tube 242 when the actuator 260 is in the closed position as illustrated in FIG. 14.

On the other hand, the actuator 260 is tilted to the dispensing position as illustrated in FIG. 15, then the front portion of the sealing plug 286 is tilted away from the top of the discharge tube 242 to permit flow of the material out of the discharge passage in the tube 242 through the dispensing nozzle 270. When the actuator 260 is tilted to the dispensing position as illustrated in FIG. 15, the lower portions of the sealing wall 271 still continue to seal the outer periphery of the upper end of the discharge tube 242 so that the container contents, while being dispensed into the nozzle 270, cannot leak out around the top of the discharge tube 242.

As illustrated in FIGS. 12, 14, and 15, the actuator 260 also includes a cam follower member 264 defining a notch 265 for engaging the ring 225 in a manner described in detail hereinafter. The cam follower member 264 depends downwardly on the actuator 260 below the dispensing channel 270.

The cam follower member 264 is laterally restrained between two, spaced-apart walls 267 which project upwardly from the closure base deck 228. The walls 267 functions as a restraint means and prevent rotational or angular displacement of the actuator 260 relative to the base 224.

As illustrated in FIG. 11, the ring 225 includes an inwardly projecting ramp 251 defining a portion of a helix. The ramp 251 is adapted to be received in the notch 265 in the cam follower member 264 of the actuator 260.

The ring 225 also includes three, circumferentially spaced-apart, upper, retaining members 301, 302, and 303. The upper retention members are adapted to be received on a shoulder 310 (FIGS. 11–15) defined around the closure base 224 at the top of the cylindrical wall 226.

The ring 225 also includes two, lower retention members 316 and 318 as illustrated in FIG. 11. The lower retention members 316 and 318 are adapted to engage the bottom edge of the closure base peripheral wall 226 (as illustrated in FIGS. 14 and 15 for the lower retention member 316).

To aid in assembling the ring 225 on the closure base 224, the lower retention members 316 and 318 each have an angled side surface, and the closure base peripheral wall 226 defines a pair of angled notches—one of the notches 320 being visible in FIG. 11—for accommodating axial displacement of the lower retention members 316 and 318 past the side of the closure base wall 226 into position on the bottom of the wall 226.

The actuator 260, hinge strap 266, and base 224 are typically molded from a thermoplastic material as a unitary structure in the orientation illustrated in FIG. 12. The sleeve 225 is separately molded. The unitary structure of the base 224, hinge strap 226, and actuator 260 is then manipulated into position within the ring 225 so that the cam ramp 251 is received within the cam follower notch 265.

Relative axial motion is effected during assembly so as to seat the ring upper retention members 301, 302, and 303 on the closure base shoulder 310 and so as to drive the lower retention members 316 and 318 past the base side wall notches (e.g., notch 320 in FIG. 11) and into engagement with the bottom of the closure base peripheral wall 226 (as illustrated for lower retention 316 in FIGS. 14 and 15). It may be desirable or necessary with some designs to provide parts with flexible portions or to provide a two-piece, or split, ring 225 to accommodate assembly. Further, the base 224 and actuator 260 could be initially molded as separate pieces. This would require the strap hinge 206 to be replaced with a suitable two-piece hinge that can be appropriately engaged when the actuator 260 is initially mounted on the closure base 224.

It is apparent that when the closure is fully assembled, rotation of the ring 225 in one direction or the other will open or close the closure by causing the actuator 260 to be tilted upwardly or downwardly. Appropriate stops can be provided on the shoulder 310 at the desired limits of the tilting motion. For example, FIG. 11 illustrates a stop or abutment 330 which can be engaged on one side by an end of the ring upper retention member 301 and which can be engaged on the other side by an end of the ring upper retention member 303. The location of the stop 330 and spacing of the upper retention members 301 and 303 are selected so that the upper retention member 301 engages the stop 330 when the actuator 260 is in the fully opened position (FIG. 15) and so that the ring upper retention member 303 engages a stop 330 when the actuator 260 is in the fully lowered or closed position (FIG. 14).

In both of the illustrated embodiments (FIGS. 1–8 and 9–15), the cam drive means is confined to a relatively small region on the front of the actuator and ring. The cam drive means is spaced from the discharge passage and is generally (substantially) diametrically opposite the hinge means.

It will be appreciated that the present invention accommodates fabrication of a novel closure in various suitable configurations for use with a variety of containers, for use with a variety of container/closure attachment modes, and for use in a variety of applications.

The closure of the present invention can be readily molded from thermoplastic materials in a design that provides a "high-style" exterior configuration which is substantially free from functional details.

Indeed, because the closure can be provided with a smooth, cylindrical ring surrounding a flat actuator top, a user confronted with such a closure on a container would typically attempt to open the closure by rotating the collar in the unscrewing direction (for the conventional right-hand thread which is so widely used throughout the world). Even if the user had not previously used such a closure, the user would undoubtedly attempt to open the closure by unscrewing it in the conventional manner. Of course, this would result in the dispensing closure being moved to the dispensing, open orientation.

Because the closure is susceptible to being so easily opened by the ordinary person without special instructions, it is believed that the closure can be effectively used on containers without providing opening instructions. Thus, the exterior of the closure can provide a "high-style", smooth, sleek, exterior surface configuration unencumbered by instructional nomenclature or indicia which are so often found on other types of closures.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator mounted on said base for movement between a closed position occluding said discharge passage and an open position permitting flow out of said discharge passage;

restraint means on said base for preventing relative rotational movement between said base and said actuator about said central axis;

a ring mounted on said base for rotation relative to said base and actuator about said central axis, said ring defining (1) a radially inwardly extending cam member and (2) a radially inwardly extending stop member;

said actuator defining at least one groove that extends at least along a portion of a helix for receiving said cam member in driving engagement; and one of said base and actuator defining an abutment axially aligned with said stop member whereby rotation of said ring in a selected direction carries said cam member in said groove to move said actuator to one of said open and closed positions and carries said stop member into engagement with said abutment to prevent further rotation in that direction.

2. The closure in accordance with claim 1 in which said base includes a pair of spaced-apart pedestals each defining a fulcrum member having a circular arc engaging surface; and said actuator defines a dispensing passage for communicating with said base discharge passage when said actuator is in said open position, said actuator further having a pair of spaced-apart bearing members each defining a circular arc bearing surface for engaging one of said fulcrum members to accommodate tilting of said actuator relative to said base between said open and closed positions.

3. The closure in accordance with claim 1 in which at least a portion of one of said ring and base are resilient to accommodate temporary radial deflection, said base defining an outwardly projecting flange, said ring having a generally cylindrical inner surface around said flange, said ring defining at least one lower retention member that projects inwardly from said inner surface and terminates in a distal inner edge, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, said lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

4. The closure in accordance with claim 1 in which said base includes a flange defining two, spaced-apart oppositely facing, annular surfaces joined at their radially outwardly most circumferential edges by a peripheral surface;

said abutment projects axially from one of said annular surfaces of said flange;

said ring defines a generally cylindrical inner surface around said actuator base flange; and said stop member is defined by an upper retention member extending radially inwardly from said ring inner surface to overlie a portion of said one annular surface of said flange.

5. The closure in accordance with claim 1 in which said base includes a flange;

said ring stop member is separated from said ring cam member and is circumferentially spaced from said cam member; and said abutment projects upwardly from said base flange to engage said stop member.

6. The closure in accordance with claim 1 in which said abutment is defined in said actuator by a closed end of said groove; and said ring cam member also functions as said stop member so that said cam member and stop member are each defined by the same structure.

7. The closure in accordance with claim 1 in which said ring includes two of said cam members and two of said stop members; and said actuator includes two of said grooves.

8. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator carried by said base and a hinge means transversely spaced from said base discharge passage for mounting said actuator on said base to accommodate tilting of said actuator between a closed position occluding said discharge passage and an open position permitting flow out of said discharge passage;

restraint means on said base for preventing relative rotational movement between said base and actuator about said central axis; and a ring mounted on said base for rotation relative to said base and actuator about said central axis, said ring and actuator together cooperatively defining a cam drive means for effecting said tilting of said actuator, said cam drive means being spaced from said base discharge passage and generally diametrically opposite said hinge means.

9. The closure in accordance with claim 8 in which said cam drive means includes a pair of spaced-apart grooves defined in said actuator wherein said grooves (1) each define a portion of a helix, and (2) are circumferentially offset relative to each other but have the same axial position on said actuator; and a pair of cam members defined by said ring for each being received in one of said grooves whereby rotation of said ring in a selected direction carries said cam members in said grooves to effect said tilting of said actuator.

10. The closure in accordance with claim 8 in which at least a portion of one of said ring and base are resilient to accommodate temporary radial deflection, said base defining an outwardly projecting flange, said ring having a generally cylindrical inner surface around said flange, said ring defining at least one lower retention member that projects inwardly from said inner surface and terminates in a distal inner edge, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, said lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

11. The closure in accordance with claim 8 in which said hinge means is a strap unitary with, and connecting, said base and actuator.

12. The closure in accordance with claim 8 in which said cam drive means includes an inwardly projecting ramp defining a portion of a helix on said ring, and a cam follower member defining a notch in said actuator for receiving said ramp.

13. The closure in accordance with claim 8 in which said restraint means includes two spaced-apart walls on said base for engaging a portion of said actuator at a location spaced from said hinge means.

14. The closure in accordance with claim 8 in which said restraint means includes coacting surfaces integral with said hinge means.

15. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator mounted on said base for tilting between a closed position occluding said discharge passage and an open position permitting flow out of said discharge passage;

a ring mounted on said base for rotation relative to said base and actuator about said central axis, said ring and actuator base together cooperatively defining a cam drive means for effecting said tilting of said actuator; and said base including a pair of spaced-apart pedestals each defining a fulcrum member having an engaging surface that defines a circular arc, said actuator having a pair of spaced-apart bearing members each defining a circular arc bearing surface for engaging one of said fulcrum members to accommodate said tilting of said actuator, said fulcrum members functioning to prevent relative movement between said base and said actuator about said central axis.

16. The closure in accordance with claim 15 in which said actuator defines a dispensing passage for communicating with said base discharge passage when said actuator is in said open position.

17. The closure in accordance with claim 15 in which said cam drive means includes a pair of spaced-apart grooves defined in said actuator wherein said grooves (1) each define a portion of a helix, and (2) are circumferentially offset relative to each other but have the same axial position on said actuator; and a pair of cam members defined by said ring for each being received in one of said grooves whereby rotation of said ring in a selected direction carries said cam members in said grooves to effect said tilting of said actuator.

18. The closure in accordance with claim 15 in which at least a portion of one of said ring and base are resilient to accommodate temporary radial deflection, said base defining an outwardly projecting flange, said ring having a generally cylindrical inner surface around said flange, said ring defining at least one lower retention member that projects inwardly from said inner surface and terminates in a distal inner edge, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, said lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

19. A dispensing closure for a container, said closure comprising:

a base and mounting means on said base for mounting said base to said container at an opening thereto, said base being restrained against rotation about a central axis relative to said container during normal operation of said closure, said base defining a discharge passage for communicating with the container opening;

an actuator mounted on said base for tilting between a closed position occluding said discharge passage and an open position permitting flow out of said discharge passage;

restraint means on said base for preventing relative rotational movement between said base and said actuator about said central axis;

a ring mounted on said base for rotation relative to said base and actuator about said central axis, said ring and actuator together defining a cooperating cam drive means for effecting said tilting of said actuator between said open and closed positions; and at least a portion of one of said ring and base being resilient to accommodate temporary radial deflection, said base defining a flange, said ring having a generally cylindrical inner surface around said flange, said ring defining at least one lower retention member that projects inwardly from said inner surface and terminates in a distal inner end, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, said lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

20. The closure in accordance with claim 19 in which said cam drive means includes a pair of spaced-apart grooves defined in said actuator wherein said grooves (1) each define a portion of a helix, and (2) are circumferentially offset relative to each other but have the same axial position on said actuator; and a pair of cam members defined by said ring for each being received in one of said grooves whereby rotation of said ring in a selected direction carries said cam members in said grooves to effect said tilting of said actuator.

21. A dispensing closure for a container, said closure comprising:

a base and mounting means on said base for mounting said base to said container at an opening thereto to restrain said base against rotation relative to said container during normal operation of said closure, said base defining a discharge passage for communicating with the container opening;

an actuator and hinge means radially spaced from said base discharge passage for mounting and holding said actuator on said base to prevent relative rotational movement between said base and actuator about a central axis and to accommodate tilting of said actuator between a closed position occluding said discharge passage and an open position permitting flow out of said discharge passage;

a ring mounted on said base for rotation relative to said base and actuator about said central axis;

said actuator defining a pair of spaced-apart, grooves that (1) are each circumferentially spaced from said hinge means, (2) each define a portion of a helix, and (3) are circumferentially offset relative to each other but have the same axial position on said actuator; and said ring defining a pair of cam members for each being received in one of said grooves whereby rotation of said ring in a selected direction carries said cam members in said grooves to tilt said actuator relative to said base.

22. The closure in accordance with claim 21 in which said base includes a pair of spaced-apart pedestals each defining a fulcrum member having a circular arc engaging surface; and said actuator defines a dispensing passage for communicating with said base discharge passage when said actuator is in said open position, said actuator further having a pair of spaced-apart bearing members each defining a circular arc bearing surface for engaging one of said fulcrum members to accommodate tilting of said actuator relative to said base between said open and closed positions.

23. The closure in accordance with claim 21 in which at least a portion of one of said ring and base are resilient to accommodate temporary radial deflection, said base defining an outwardly projecting flange, said ring having a generally cylindrical inner surface around said flange, said ring defining at least one lower retention member that projects inwardly from said inner surface and terminates in a distal inner edge, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, said lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

24. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator carried by said base and a hinge means transversely spaced from said base discharge passage for mounting said actuator on said base to accommodate tilting of said actuator between a closed position occluding said discharge passage and an open position permitting flow out of said discharge passage;

restraint means on said base for preventing relative rotational movement between said base and actuator about said central axis; and a ring mounted on said base for rotation relative to said base and actuator about said central axis, said ring and actuator together cooperatively defining a cam drive means for effecting said tilting of said actuator, said cam drive means being spaced from said base discharge passage and generally diametrically opposite said hinge means, said cam drive means including a pair of spaced-apart grooves defined in said actuator wherein said grooves (1) each define a portion of a helix, and (2) are circumferentially offset relative to each other but have the same axial position on said actuator; and a pair of cam members defined by said ring for each being received in one of said grooves whereby rotation of said ring in a selected direction carries said cam members in said grooves to effect said tilting of said actuator.

25. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator carried by said base and a hinge means transversely spaced from said base discharge passage for mounting said actuator on said base to accommodate tilting of said actuator between a closed position occluding said discharge passage and an open position permitting flow out of said discharge passage;

restraint means on said base for preventing relative rotational movement between said base and actuator about said central axis; and a ring mounted on said base for rotation relative to said base and actuator about said central axis, said ring and actuator together cooperatively defining a cam drive means for effecting said tilting of said actuator, said cam drive means being spaced from said base discharge passage and generally diametrically opposite said hinge means, at least a portion of one of said ring and base being resilient to accommodate temporary radial deflection, said base defining an outwardly projecting flange, said ring having a generally cylindrical inner surface around said flange, said ring defining at least one lower retention member that projects inwardly from said inner surface and terminates in a distal inner edge, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, and lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

26. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator carried by said base and a hinge means transversely spaced from said base discharge passage for mounting said actuator on said base to accommodate tilting of said actuator between a closed position occluding said discharge passage and an open position permitting flow out of said discharge passage, said hinge means including a strap unitary with, and connecting, said base and actuator;

restraint means on said base for preventing relative rotational movement between said base and actuator about said central axis; and a ring mounted on said base for rotation relative to said base and actuator about said central axis, said ring and actuator together cooperatively defining a cam drive means for effecting said tilting of said actuator, said cam drive means being spaced from said base discharge passage and generally diametrically opposite said hinge means.

27. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator carried by said base and a hinge means transversely spaced from said base discharge passage for mounting said actuator on said base to accommodate tilting of said actuator between a closed position occluding said discharge passage and an open position permitting flow out of said discharge passage, said hinge means including a strap unitary with, and connecting, said base and actuator;

restraint means on said base for preventing relative rotational movement between said base and actuator about said central axis, said restraint means including coacting surfaces integral with said hinge means; and a ring mounted on said base for rotation relative to said base and actuator about said central axis, said ring and actuator together cooperatively defining a cam drive means for effecting said tilting of said actuator, said cam drive means being spaced from said base discharge passage and generally diametrically opposite said hinge means.

28. A dispensing closure for a container, said closure comprising:

a base and mounting means on said base for mounting said base to said container at an opening thereto to restrain said base against rotation about a central axis relative to said container during normal operation of said closure, said base defining a discharge passage for communicating with the container opening;

an actuator mounted on said base for tilting between a closed position occluding said discharge passage and an open position permitting flow out of said discharge passage;

a ring mounted on said base for rotation relative to said base and actuator about said central axis, said ring and actuator base together cooperatively defining a cam drive means for effecting said tilting of said actuator;

said base including a pair of spaced-apart pedestals each defining a fulcrum member having an engaging surface that defines a circular arc, said actuator having a pair of spaced-apart bearing members each defining a circular arc bearing surface for engaging one of said fulcrum members to accommodate said tilting of said actuator, said fulcrum members functioning to prevent relative movement between said base and said actuator about said central axis; and said cam drive means including a pair of spaced-apart grooves defined in said actuator wherein said grooves (1) each define a portion of a helix, and (2) are circumferentially offset relative to each other but have the same axial position on said actuator; and a pair of cam members defined by said ring for each being received in one of said grooves whereby rotation of said ring in a selected direction carries said cam members in said grooves to effect said tilting of said actuator.

29. A dispensing closure for a container, said closure comprising:

a base and mounting means on said base for mounting said base to said container at an opening thereto to restrain said base against rotation about a central axis relative to said container during normal operation of said closure, said closure defining a discharge passage for communicating with the container opening;

an actuator mounted on said base for tilting between a closed position occluding said discharge passage and an open position permitting flow out of said discharge passage;

a ring mounted on said base for rotation relative to said base and actuator about said central axis, said ring and actuator base together cooperatively defining a cam drive means for effecting said tilting of said actuator;

said base including a pair of spaced-apart pedestals each defining a fulcrum member having an engaging surface that defines a circular arc, said actuator having a pair of spaced-apart bearing members each defining a circular arc bearing surface for engaging one of said fulcrum members to accommodate said tilting of said actuator, said fulcrum members to accommodate said tilting of said actuator, said fulcrum members functioning to prevent relative movement between said base and said actuator about said central axis; and at least a portion of one of said ring and base being resilient to accommodate temporary radial deflection, said base defining an outwardly projecting flange, said ring having a generally cylindrical inner surface around said flange, said ring defining at least one lower retention member that projects inwardly from said inner surface and terminates in a distal inner edge, said ring further defining at least one upper retention member that projects inwardly from said inner surface and that is axially spaced from said lower retention member, said upper retention member having an engaging surface facing generally in the axial direction toward said lower retention member, said lower retention member defining a support surface facing generally in the axial direction toward said upper retention member, said lower retention member further defining a guide surface extending from said distal inner end of said lower retention member toward said ring cylindrical inner surface so that the axial distance between said support surface and guide surface increases with increasing radial distance from said inner end of said lower retention member whereby said base can be inserted into said ring with said ring flange being guided by said lower retention member guide surface to radially deflect at least a portion of one of said base and ring to accommodate movement of said base flange past said inner end of said lower retention member and to effect lodgement of said base flange between said ring upper and lower retention members.

* * * * *